United States Patent [19]

Engel

[11] 3,975,470

[45] Aug. 17, 1976

[54] HUMIDIFIER HAVING A WATER DISTRIBUTOR TROUGH

[75] Inventor: Lewis O. Engel, Mount Clemens, Mich.

[73] Assignee: General Filters, Inc., Novi, Mich.

[22] Filed: May 8, 1974

[21] Appl. No.: 467,852

[52] U.S. Cl. ..... 261/106; 126/113; 261/DIG. 15

[51] Int. Cl.[2] ..... B01F 3/04

[58] Field of Search ..... 261/97, 106, 110, DIG. 15, 261/DIG. 44; 126/113

[56] References Cited

UNITED STATES PATENTS

| | | | |
|---|---|---|---|
| 2,281,799 | 5/1942 | Quave | 261/97 X |
| 2,809,820 | 10/1957 | Stoops | 261/106 |
| 3,193,259 | 7/1965 | Liebmann | 261/97 X |
| 3,199,846 | 8/1965 | Durham et al. | 261/97 X |
| 3,318,587 | 5/1967 | McDuffee | 126/113 X |
| 3,401,681 | 9/1968 | McDuffee, Sr. | 126/113 |
| 3,437,318 | 4/1969 | Abbott et al. | 261/DIG. 15 |
| 3,464,401 | 9/1969 | McGrath | 126/113 |
| 3,497,453 | 2/1970 | Yurdin | 261/97 X |
| 3,570,822 | 3/1971 | Peterson et al. | 261/106 X |
| 3,774,588 | 11/1973 | Yeagle | 261/DIG. 15 |
| 3,867,486 | 2/1975 | Nagele | 261/106 X |

*Primary Examiner*—Tim R. Miles
*Assistant Examiner*—Richard L. Chiesa
*Attorney, Agent, or Firm*—Whittemore, Hulbert & Belknap

[57] ABSTRACT

A humidifier for use with an air system, and especially adapted for installation on a forced air furnace. Water distribution means are employed to provide a substantially uniformly distributed flow of water to an evaporator pad. The water distribution means comprises an elongated rectangular tray having an elevated water reservoir and channels leading to apertures positioned so as to distribute water uniformly to the pad. Generally V-shaped metering notches are provided in the walls of the reservoir to meter the flow of water to the respective channels.

6 Claims, 7 Drawing Figures

14
162
88
94
98
58
98
96
32
36
34
48
52
56
58
50
68
134
86
144
142
160
114
146
3
106
124
122
76
148
142
144
112
84
112
136
130
114
90
98
94
58
10
96
18
156
150
154
152
154
158
30
60
56
58
60
50
52
68
46
38
66
12
72
3
74
64
16

HUMIDIFIER HAVING A WATER DISTRIBUTOR TROUGH

SUMMARY OF THE INVENTION

The proper distribution of water to the evaporator pad is an important consideration in the design of a humidifier. It is highly desirable that the water be uniformly dispersed over the entire pad area. It is also desirable that the distribution of water remain uniform despite slight errors in the mounting of the humidifier. Altho the humidifier should be mounted in a perfectly level position, this condition is not always achieved in practice. The water distribution means of my invention is capable of a substantially uniform distribution of water to the evaporator pad even though the humidifier is not perfectly level.

In accordance with a preferred embodiment of the invention about to be described, the water distribution means comprises an elongated rectangular tray positioned over the evaporator pad and having a raised reservoir with channels leading to apertures through which water is distributed over the total area of the pad. The apertures preferably terminate in tubular extensions beneath the bottom of the tray so that the water will not collect and drop to the pad from one point.

Metering passages place the reservoir in communication with the channels. These metering passages are preferably in the form of generally V-shaped notches dimensionally identical to provide equal flow from all notches for a given head of water on the upstream side.

The humidifier also has improved means for mounting the tray. Mounting flanges on the tray and on the humidifier housing cooperate to provide tapered clip-receiving projections. Clips having the same taper as the projections removably secure the tray in position.

As a further feature of the invention, the tray removably secured to the top of the humidifier housing and a drain pan removably secured to the bottom of the housing may be interchanged permitting the housing to be inverted for a right or left hand bypass duct installation.

Figure 1:
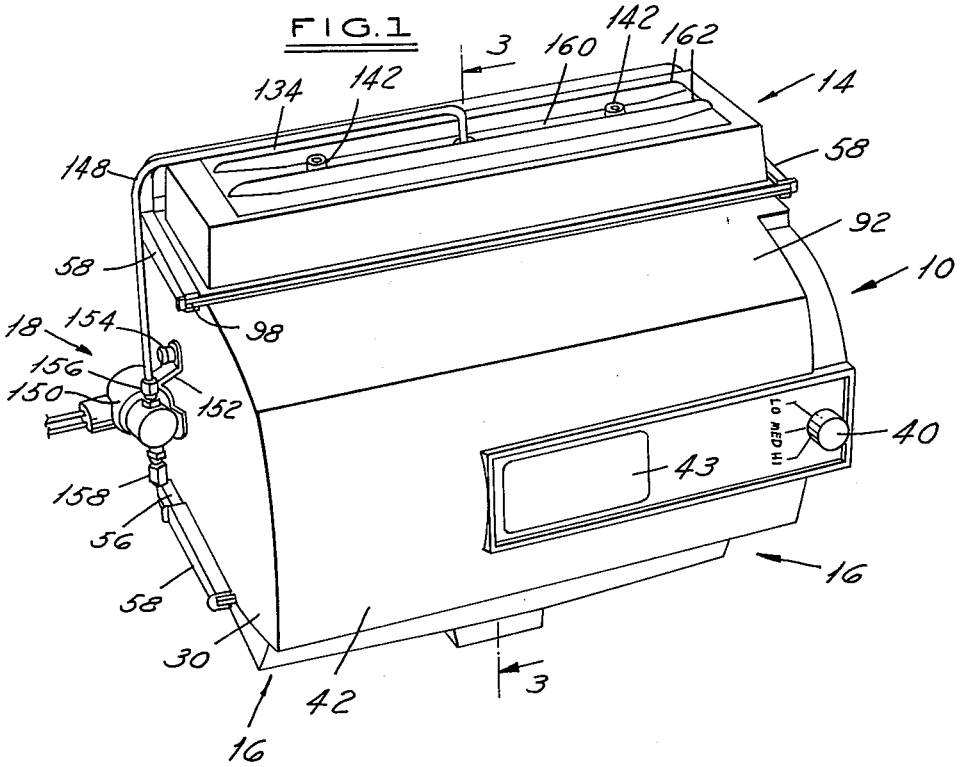
FIG. 1 is a perspective view of a humidifier constructed in accordance with my invention.
Figure 5:
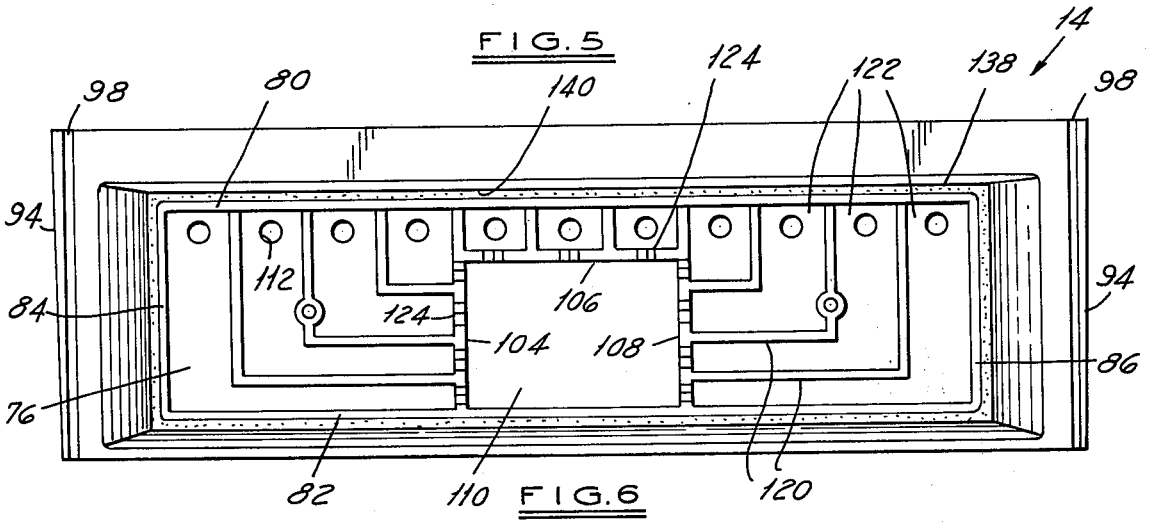
FIG. 5 is a top plan view of the water distribution tray with the cover removed.
Figure 6:
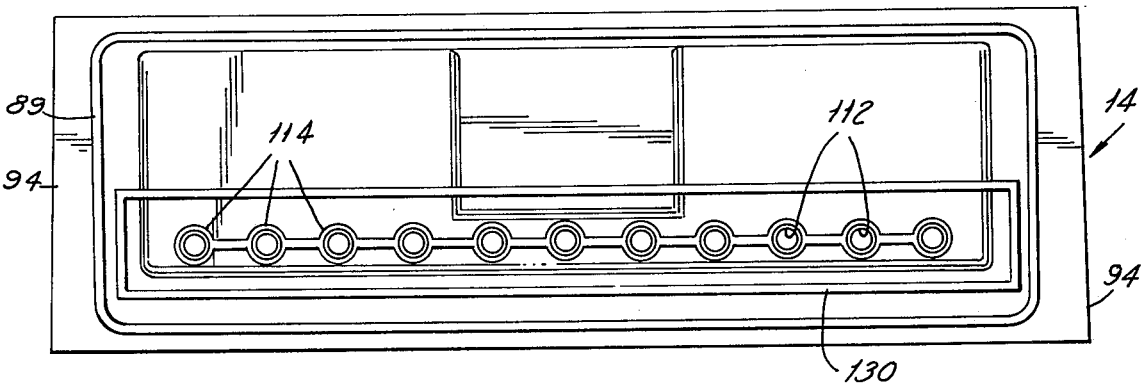
FIG. 6 is a bottom plan view of the tray.
Figure 2:
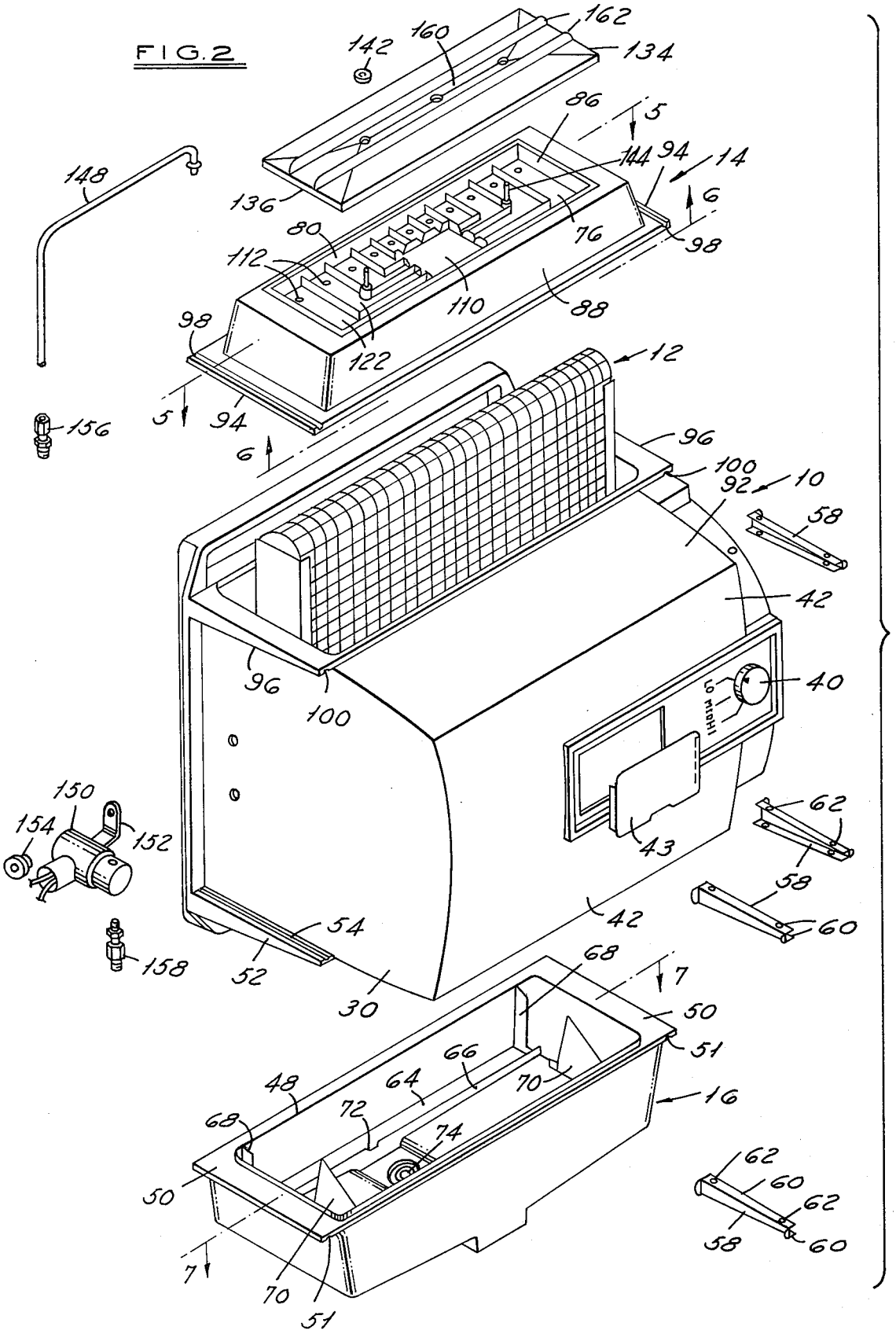
FIG. 2 is an exploded view of the humidifier.
Figure 7:
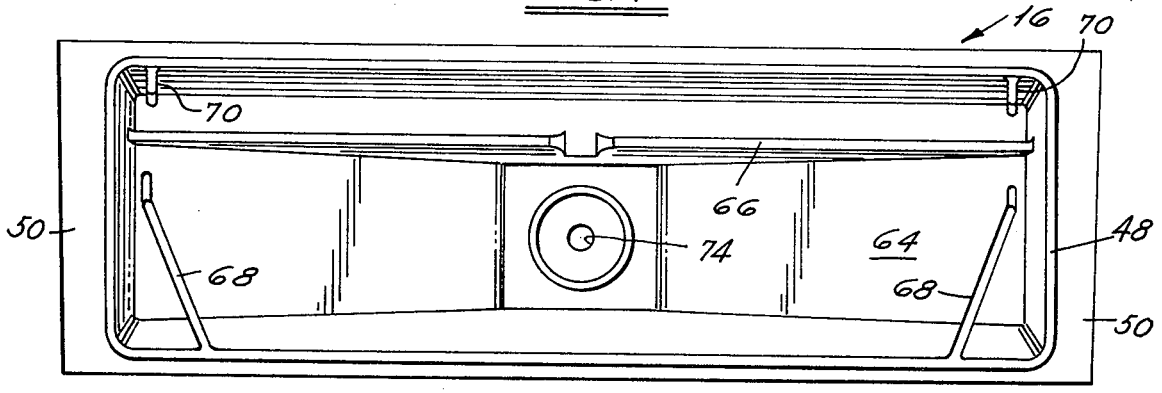
FIG. 7 is a top plan view of the drain pan.

Referring now more particularly to the drawings, the humidifier comprises a housing 10, an evaporator pad 12 within the housing, a water distribution trough or tray 14 removably mounted on the top of the housing, a drain pan 16 removably secured to the bottom of the housing, and water supply means 18 for delivering water to the distributor trough or tray.

Figure 3:
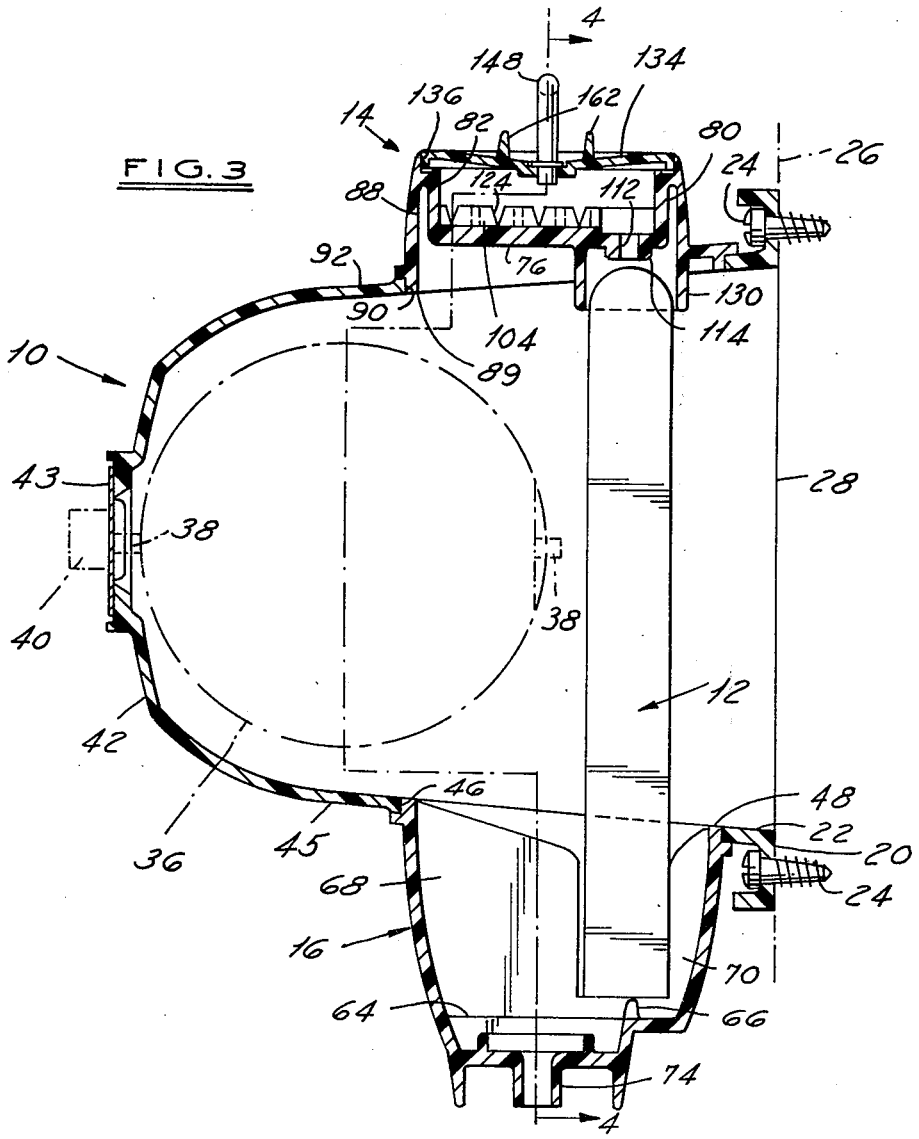
FIG. 3 is a sectional view taken on the line 3—3 in FIGS. 1 and 4.

The housing 10 is adapted to be installed on any vertical surface of an air system, particularly a forced air furnace. As shown in FIG. 3, the flat rear wall 20 of the housing has a central opening 22 which is removably secured as by sheet metal screws 24 to a vertical surface 26 of a forced air furnace over an opening 28 therein.

The housing has side walls 30 and 32. The side wall 30 has the water supply means 18 mounted thereon as will be described more fully hereinafter. The side wall 32 has a circular opening 34 therein, the effective size of which is controlled by a circular damper or closure plate 36 hinged by pins 38 journaled in opposite sides of the opening 34 and controlled as to its position by a control knob 40 connected to one of the pins 38 and disposed on the front wall 42 of the housing. A name plate 43 mounted on the front wall 42 is removable to enable the inside of the humidifier to be inspected.

The evaporator pad 12 is supported upright within the housing between the opening 34 in a side wall 32 and the opening 22 in the rear wall 20. Accordingly, air moving through the system must flow through the evaporator pad to pick up moisture contained therein. The evaporator pad may be formed of any suitable construction and normally is made of a foraminous material having numerous small though unobstructed passages adapted to retain water by capilarity to be picked up by air passing through it.

The evaporator pad is seated upon and within the drain pan 16 removably secured to the bottom of the housing. The bottom wall 45 of the housng has a rectangular opening 46 which is of complementary size and shape to the rectangular upstanding rib 48 on the top of the drain pan so as to snugly receive the latter with the end flanges 50 of the drain pan in surface contact with the flanges 52 extending outwardly from the side walls of the housing near the bottom thereof. The lower surfaces of flanges 50 have grooves 51 extending from front to rear. The upper surfaces of flanges 52 have grooves 54 extending from front to rear. Flanges 50 and 52 are mounting flanges and when in contact, provide clip-receiving projections 56, the grooved top and bottom surfaces of which are tapered as shown. Complementary channel-shaped clips 58 are provided, the opposite flanges 60 of which are longitudinally tapered to the same degree as the clip-receiving projections 56 and are provided with inward indentations or detents 62 adapted to engage in the grooves 51 and 54. These clips are pressed over the projections 56 in an endwise direction and engage therewith in tight wedging contact to removably secure the drain pan to the bottom of the housing.

The bottom 64 of the drain pan has a longitudinally extending upright rib 66 upon which the bottom of the evaporator pad is adapted to rest. Upright ribs 68 and 70 engage the front and rear surfaces of the evaporator pad to hold it up. The rib 66 has a notch 72 to permit water drainage to pass under the pad to the drain opening 74 from whence it may be discharged through a drain pipe (not shown) connected thereto.

The water distribution trough or tray 14 is rectangular in form and has a horizontal bottom wall 76, vertical side walls 80 and 82, and vertical end walls 84 and 86. The tray has a surrounding depending skirt portion 88 provided with a rib 89 of rectangular form which is adapted to fit in a complementary rectangular opening 90 in the top wall 92 of the housing. End flanges 94 on this skirt portion engage and rest upon the outwardly extending flanges 96 on the housing. These engaging flanges 94 and 96 are mounting flanges and cooperate to define clip-receiving projections 98, the top and bottom surfaces of which are tapered to the same extent as the clip-receiving projections 56. Such tapered surfaces also have grooves 98 and 100 extending from front to rear. Additional clips 58 identical to those previously described and applied in the same way, are used to secure the engaged flanges 94 and 96 together to removably mount the water distribution tray on the housing. Obviously these clips are interchangeable with one another.

The bottom wall 76 of the tray has internal vertical wall elements 104, 106 and 108 which together with the side wall 82 form a rectangular reservoir 110 midway between the end walls. The parallel wall elements 104 and 108 extend perpendicular to the side wall 82 and the wall element 106 extends parallel thereto. Circular apertures 112 are formed in the bottom wall at uniformly spaced intervals along the length of the bottom wall adjacent to the side wall 80. These apertures 112 are all of the same diameter and are disposed directly over the upper edge of the evaporator pad 12 and terminate in depending tubular extensions 114. The purpose of these extensions is to prevent water from clinging to the undersurface of the tray and dropping on one portion only of the evaporator pad.

Figure 4:
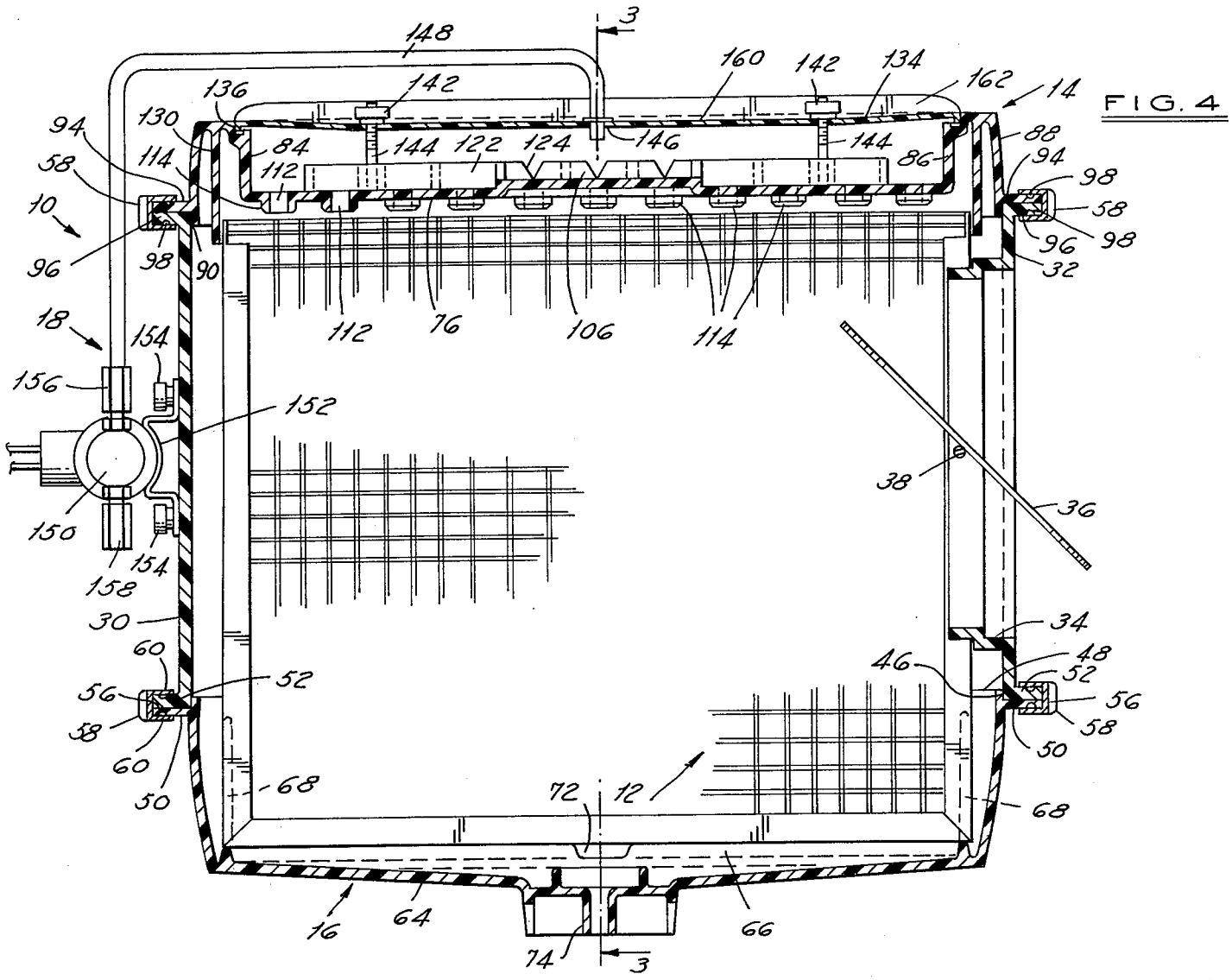
FIG. 4 is a sectional view taken on the line 4—4 in FIG. 3.

The bottom 76 of the tray has additional vertical internal wall elements 120 which define channels 122 extending from the reservoir forming wall elements 104, 106 and 108 to the respective apertures 112. Each channel leads to one of the apertures. The bottom wall of the reservoir 110 is elevated relative to the bottom walls of the channels 122 to provide a head of water in the reservoir. (See FIG. 4).

Metering passages are provided to transfer water from the reservoir 110 to the channels 122 for ultimate discharge through the apertures 112. One such metering passage is provided in communication with each channel. Each metering passage is in the form of a V-shaped notch 124 in the top edge of one of the reservoir forming wall elements 104, 106 and 108. The notches 124 are of identical size and shape. As the water supply rises in the reservoir, more and more water is discharged through the metering notches 124 into the respective channels.

The water distribution tray has a depending rectangular skirt or shroud 130 which surrounds the tubular extensions 114 of the apertures and also surrounds the upper edge portion of the evaporator pad. This shroud or skirt 130 stabilizes the evaporator pad and holds it upright and also prevents the water dripping from the apertures from being deflected away from the pad by the air flow through the humidifier.

The rib 89 on the tray 14 is the same size and shape as the rib 48 on the drain pan 16, and the opening 90 in the top wall 92 of the housing is the same size and shape as the opening 46 in the bottom wall 45 of the housing. Accordingly, the tray 14 and drain pan 16 are interchangeable, that is, the tray 14 can be mounted over the opening 46 and the drain pan 16 can be mounted over the opening 90 in the event it is necessary to invert the housing. The mounting flanges 52 and 92 on the housing are identical tapered and grooved members as shown, and the mounting flanges 50 on the drain pan 16 and 94 on the tray 14 are identically formed and grooved, such that the clips 58 can mount the tray and drain pan to either the housing mounting flanges 52 or 96.

The tray 14 has a cover or lid 134 which is rectangular in form and has a sealing rib 136 extending around its periphery for contact with a sealing element 138 disposed in the rectangular groove 140 formed in the top surface of the tray around its side and end walls. The cover 134 is removably secured to the tray by any suitable means, here shown as comprising nuts 142 threaded on upright posts 144 molded into certain of the internal wall elements 120. The top surface of the tray has a central aperture 146 located over the reservoir 110. A water supply tube 148 has its discharge end secured in the hole 146 to supply water to the reservoir. The tube 148 is connected to a suitable pump or similar means (not shown) for supplying water under pressure. The flow of water to the pipe 148 is controlled by a solenoid valve 150 carried by a bracket 152 secured to the side wall 30 of the housing by fasteners 154. A fitting 156 connects the tube 148 to the valve and a second fitting 158 is for connecting the valve to a water pump or the like. The solenoid valve may be connected with the blower circuit of the furnace so as to open when the furnace blower is on and close when the blower is off. A humidistat may be connected in series with the solenoid valve to provide automatic control of relative humidity in the humidified air space.

Preferably the upper surface of the cover 134 is downwardly dished where indicated at 160 around the central opening 146, and has the laterally spaced longitudinally extending strengthening ribs 162. In the event that water from the tube 148 should leak at the cover opening 146, it will collect in the dished central portion of the cover and ultimately drain through the cover into the reservoir. The ribs 162 also help in confining any water that might collect in the dished portion.

In use, the humidifier is mounted as shown in FIG. 3 with care so that the bottom of the tray 14 is horizontal. In that way, an equal distribution of water through the various apertures 112 will be assured. However, because of the construction of the metering notches and the channels leading to the various apertures, any slight departure from horizontal will not particularly affect the uniform distribution of water to the evaporator pad. The reservoir 110 is midway between the end walls of the tray. Hence even if the tray is tipped so that one end is a certain distance below the other end, the distance that one of the reservoir defining wall elements 104, 108 is below the other is much less. Accordingly, even if the tray is tipped slightly, the notches 124 in the two wall elements 104, 108 will discharge substantially the same flow of water. The elevated bottom of the reservoir 110 creates a head of water to facilitate the transfer of water through the metering notches into the channels.

The clips 58 together with the clip-receiving projections 56 and 98 provide a convenient means for removably mounting the tray and the drain pan on the housing. These parts can be readily removed for cleaning.

Sometimes because of the location of the furnace piping or plumbing, it is necessary or desirable to turn the humidifier housing upside down so that the plumbing may be on the right and the air duct 34 on the left rather than in the positions shown in FIG. 1. In that event, and because the tray 14 and drain pan 16 are interchangeable, these two parts may be removed and interchanged, securing the tray to the bottom wall 45 of the housing which is now at the top, and the drain pan to the top wall 92 of the housing which is now at the bottom.

What I claim as my invention is:

1. A humidifier adapted to be connected to an air system comprising a housing having means providing communication with the air system, and evaporator pad mounted in said housing, water distribution means disposed above said evaporator pad for providing a substantially uniformly distributed flow of water to said evaporator pad, said water distribution means comprising an elongated rectangular tray having a bottom wall and upright side and end walls, said tray having a portion of its bottom wall midway between and spaced from said end walls and also spaced from one of said side walls which is separated from the remaining portion of said bottom wall by internal upright wall elements to provide a water reservoir, said reservoir being defined in part by the other of said side walls, said internal wall elements being spaced from said one side wall, a plurality of longitudinally spaced apertures formed in the bottom wall of said tray in the portion thereof outside said reservoir in a continuous row along said one side wall from one end wall to the other, additional internal upright wall elements extending along said bottom wall in the portion thereof outside said reservoir providing channels from said internal wall elements to said respective apertures, metering passages in said first mentioned internal wall elements respectively placing said channels in communication with said water reservoir, the bottom of said reservoir being elevated in relation to the portion of said bottom wall outside said reservoir, said housing having a top opening, first means for removably securing said tray over said top opening, said housing having a bottom opening, a cover for said bottom opening, second means for removably securing said cover over said bottom opening, said tray and cover being interchangeable, and said first and second securing means being adapted to secure said tray over said bottom opening and said cover over said top opening when said tray and cover are interchanged so that the humidifier may be used with said housing turned upside down.

2. The humidifier defined in claim 1, wherein said metering passages are in the form of generally V-shaped notches in the upper edges of said first mentioned internal wall elements.

3. The humidifier defined in claim 1, wherein said apertures have tubular extensions projecting downwardly beneath the lower surface of said bottom wall.

4. The humidifier defined in claim 1, wherein said tray has a skirt alongside said apertures extending downwardly beneath said bottom wall in overlapping relation to the upper portion of said evaporator pad.

5. The humidifier defined in claim 1, wherein said first securing means comprises engaging flanges on said tray and on said housing providing a tapered clip-receiving projection, said second securing means comprising engaging flanges on said cover and on said housing providing a second tapered clip-receiving projection, and channel-shaped clips longitudinally tapered to substantially the same degree as said clip-receiving projections disposed in wedging engagement with the latter.

6. The humidifier defined in claim 5, wherein said clip-receiving projections have grooves in the tapered surfaces thereof, and said clips have raised portions slidably frictionally engaging said grooves.

* * * * *